United States Patent [19]

Daum

[11] Patent Number: 4,592,671

[45] Date of Patent: Jun. 3, 1986

[54] CONNECTOR PLATE FOR FABRICATING BUILDINGS

[76] Inventor: William K. Daum, P.O. Box 5, Cambridge, Wis. 53523

[21] Appl. No.: 623,020

[22] Filed: Jun. 21, 1984

[51] Int. Cl.[4] ..... F16D 1/00

[52] U.S. Cl. ..... 403/171; 403/172; 403/217; 52/81; 52/DIG. 10

[58] Field of Search ..... 403/169–176, 403/217, 218, 219; 52/80, 81, 86, DIG. 10

[56] References Cited

U.S. PATENT DOCUMENTS

| | | | |
|---|---|---|---|
| 3,844,664 | 10/1974 | Hogan | 52/81 X |
| 4,097,043 | 6/1978 | Rudy | 403/172 X |
| 4,381,636 | 5/1983 | Sapp | 403/171 X |
| 4,384,801 | 5/1983 | Hamel | 403/172 |
| 4,511,278 | 4/1985 | Robinson | 403/172 |

*Primary Examiner*—Cornelius J. Husar
*Assistant Examiner*—Todd G. Williams
*Attorney, Agent, or Firm*—Marcus L. Bates

[57] ABSTRACT

A connector plate for erecting structures of varied configurations. The plate comprises a main body having connections formed thereon by which the ends of six different struts can be connected together in a particular manner to form a cluster, with the number of strut ends of a cluster depending upon the selected function of the cluster respective to the building desired. The connector plate has a plane of symmetry which passes longitudinally through two of the six connections, with the two connections lying in different planes arranged at an obtuse angle respective to one another, and thereby provides attachment means by which a roof strut is connected to a vertical wall strut end. This positions the roof strut at about a fifteen degree roof pitch. There are also two right and two left strut connections lying to either side of the plane of symmetry, with the two right connections lying in the same plane and intersecting one another at a 60° angle to thereby form the apex of a wall triangle. The two left connections are similarly arranged respective to one another. The plane formed by the two right strut connections lies 60° respective to the plane formed by the two left strut connections, thereby providing a cluster for use in a hexagon building having a hexagon roof made of six triangular sections. The connector plate enables the fabrication of walls which have square, rectangular, or triangular wall surfaces.

14 Claims, 16 Drawing Figures

CONNECTOR PLATE FOR FABRICATING BUILDINGS

BACKGROUND OF THE INVENTION

There's a breed of man that can't stay still, and prefers to occupy his time in various constructive endeavors, as for example, fabricating small outbuildings to accommodate the overflow of his worldly possessions. Many of these industrious fellows are not at all skilled with the use of carpentry tools, and therefore it is unlikely that they would embark upon the fool-hardy task of designing and fabricating an ordinary building unless they first could be assured that the time and cost involved was minimal; and, furthermore, they were provided with the assurance that they already had the necessary skills for completing the building. The present invention provides a means by which the average person can easily fabricate a small building with a minimum of time and effort, wherein the completed building is structurally sound and architecturally tasteful to the eye, and further, great latitude is available in selecting the overall configuration of the completed building. Apparatus which enables the construction of a building having these attributes is the subject of the present invention.

SUMMARY OF THE INVENTION

A connector plate for erecting structures of varied configurations. The connector plate comprises a main body having six strut connections so that the ends of six struts can be attached to form a cluster, wherein the cluster includes 1–6 strut ends depending upon the selective function of the cluster respective to the building desired.

The plate has a plane of asymmetric which passes through two centrally located strut connections. The two centrally located strut connections lie at an obtuse angle respective to one another in order to provide attachment means for a vertical strut member and a roof strut member. The roof strut member preferably is positioned to achieve a 20° roof pitch.

There are two right and two left strut connections positioned on either side of the plane of symmetry, with the two right connections lying in the same plane and intersecting one another to form the apex of a wall triangle. The apex is 60°. The plane formed by the two right connectors lie at 60° respective to the plane formed by the left connectors, thereby providing for a building having a hexagon outer wall and a hexagon roof, wherein the roof is made of six triangular sections. The connector plate can be used to make surfaces comprised of squares, rectangles, or triangular wall surfaces.

Accordingly, one connector plate forms one cluster which comprises 1–6 struts, as may be desired. A plurality of connector plates, each identical in design, enables a member of different geometrical surfaces to be fabricated. The geometrical surfaces are combined to form buildings of various different configurations.

A primary object of the present invention is the provision of a connector plate for attaching ends of struts into a cluster.

Another object of the present invention is the provision of a connector plate for attaching to the ends of one or more struts and thereby form part of a building structure.

A further object of the present invention is to provide a cluster plate which forms the apex of a cluster of struts, wherein the struts radiate therefrom and selectively form a building wall surface made of either squares, rectangles, or triangles.

A still further object of this invention is the provision of a connector plate having strut connections formed thereon which enable struts to be attached thereto at various different angles respective to one another.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
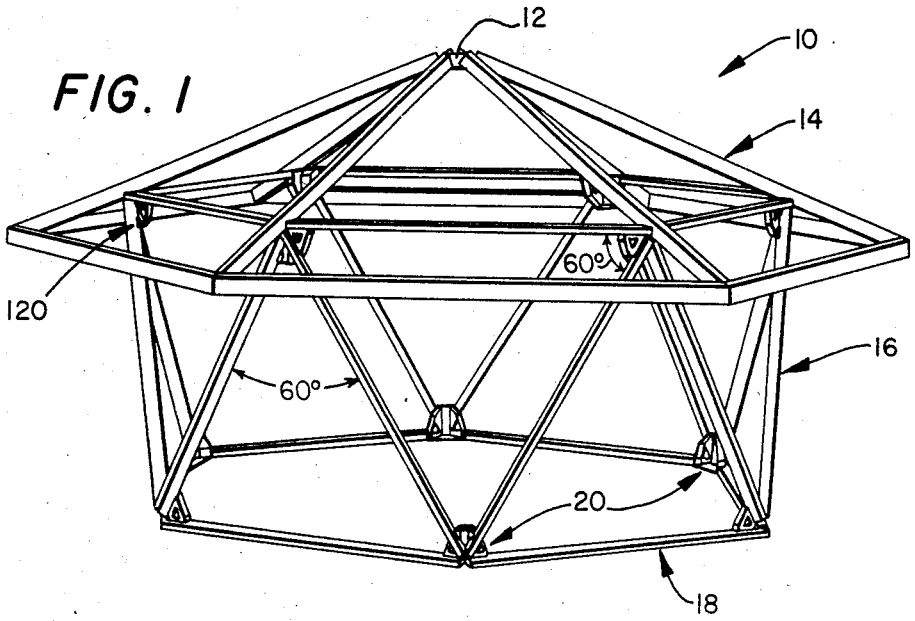
FIG. 1 is a perspective view of a frame for a building structure made in accordance with the present invention.

Throughout the various figures of the drawings, like or similar numerals refer to like or similar elements. In FIG. 1, there is disclosed a building 10 having an apex 12 formed by roof 14. The roof is supported by sides 16, and the sides are attached to a base 18.

Figure 2:
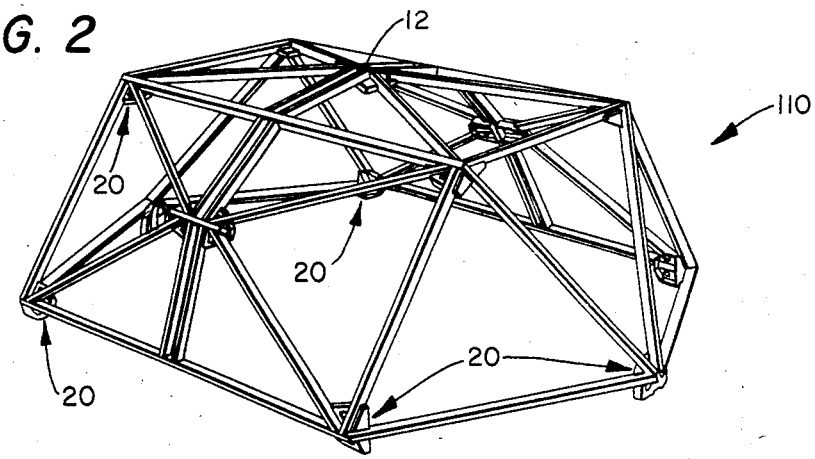
FIG. 2 sets forth a perspective view of another embodiment of a building frame made in accordance with the present invention.
Figure 3:
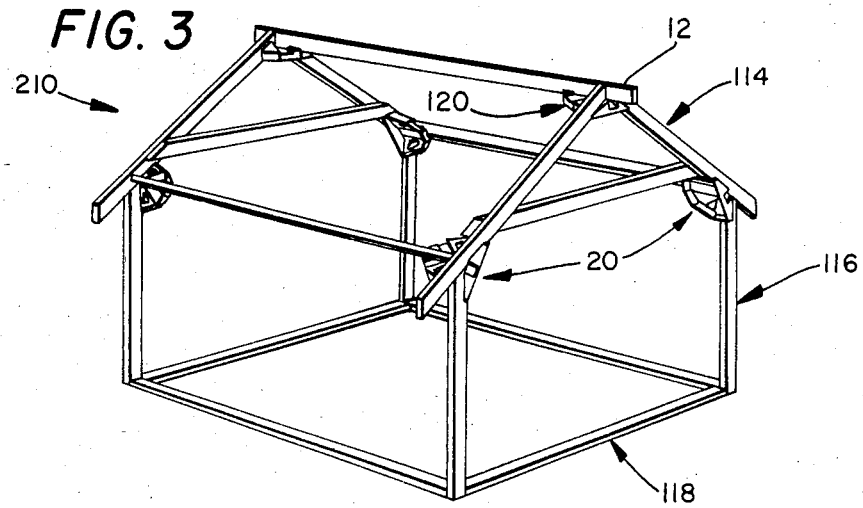
FIG. 3 sets forth a perspective view of still another embodiment of a building frame made in accordance with the present invention.

In FIGS. 1–3, together with other figures of the drawings, a connector plate 20, made in accordance with the present invention, connects the ends of the various struts together to form the illustrated plurality of clusters.

Figure 4A:
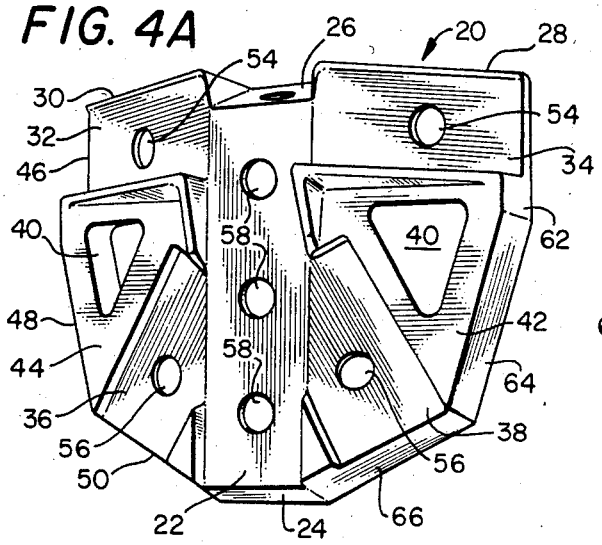
FIG. 4A is an enlarged, perspective, top view of part of the apparatus disclosed in FIGS. 1–3.
Figure 4B:
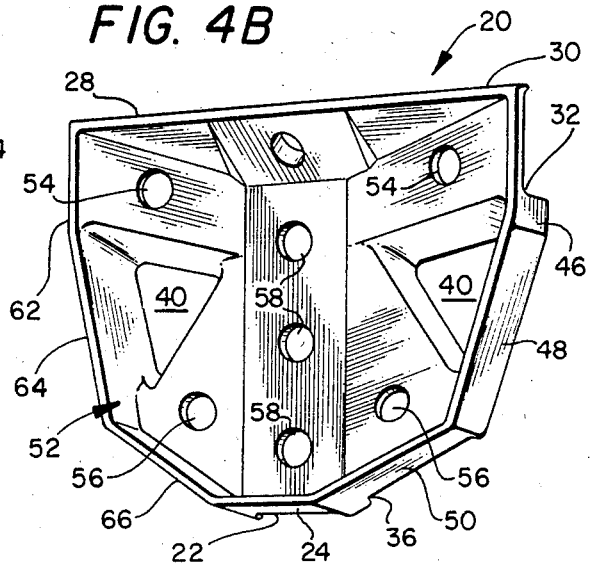
FIG. 4B is a perspective rear view of the apparatus disclosed in FIG. 4A.
Figure 5:
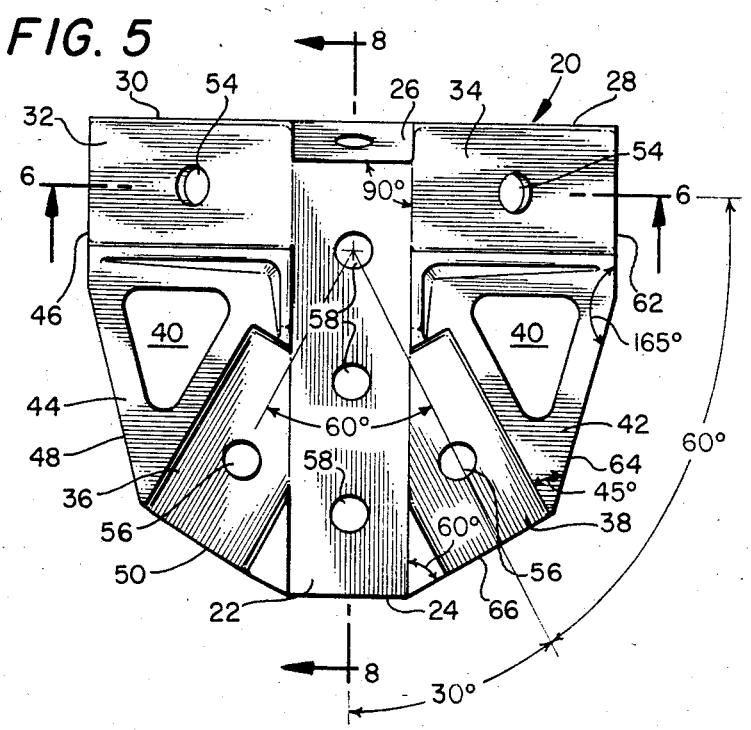
FIG. 5 is a top, elevational view of the apparatus disclosed in FIGS. 4A and 4B.

In FIGS. 4 and 5, together with other figures of the drawings, the connector plate 20 is seen to comprise a main body made of metal, preferably aluminum, which can be fabricated by die casting, although other fabricating means can be used. The connector plate has a centrally located longitudinally extending connection 22 in the form of a groove or slot which commences at one end 24 and terminates at connection 26. Connection 26 is arranged at an obtuse angle respective to connection 22. The other end of the connector plate terminates in flat wall surfaces 28 and 30 which are separated from one another by connection 26. End wall surfaces 28 and 30 are arranged at 120° respective to one another, as seen illustrated in FIGS. 6 and 7, for reasons which will be more fully appreciated later on in this disclosure.

Figure 6:
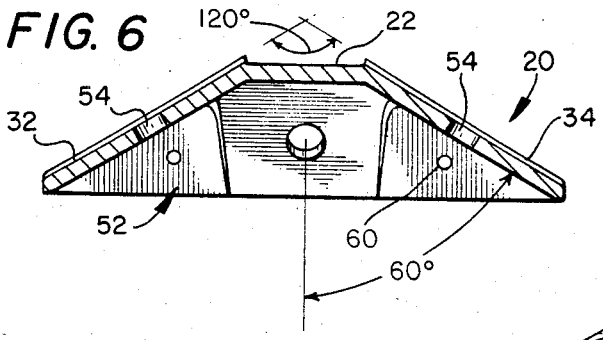
FIG. 6 is a cross-sectional view taken along line 6—6 of FIG. 5.
Figure 7:
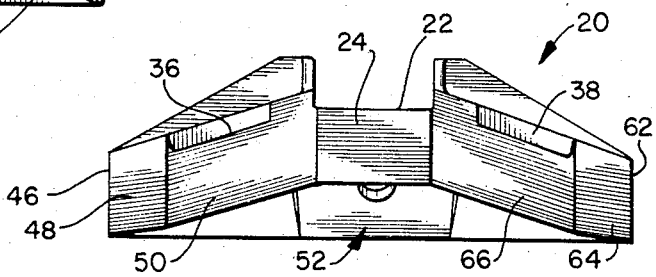
FIG. 7 is an end view of the apparatus disclosed in FIG. 5.

Opposed connections 32 and 34 are likewise arranged at an angle of 120° respective to one another as noted in FIG. 6, and are separated from one another by the longitudinal connection 22 and end connection 26.

Diagonal connections 36 and 38 are arranged at an included angle of 60° respective to one another, as noted in FIG. 5, and are separated from one another by the longitudinal connection 22. Hence, each of the diagonal connections form an included angle of 30° with respect to the longitudinal connection 22. Lightening holes 40 are provided for conserving weight and cost of fabrication. The lightening holes are defined by planer surfaces 42 and 44.

The connector plate has a geometry defined by the peripheral wall surfaces 30, 46, 48, and 50 on the left side, and wall surfaces 28, 62, 64, and 66 on the right side, with the right and left sides being symmetrical respective to one another when the connector plate is bisected by a vertical plane which extends longitudinally of connection slot 22, in a manner similar to section line 8—8 of FIG. 5, for example. As particularly noted in FIG. 5, the side 62 forms an included obtuse angle of 165° respective to side 64; side 64 forms an obtuse angle 145° respective to side 66; while sides 66 and 50 are arranged at an angle of 60° respective to the end face 24.

Numeral 52 indicates the concave hollow interior of the connector plate. Bolt holes 54–58, respectively, are formed through slots 34, 32; 36, 38; and 22, 26; respectively.

Figure 8:
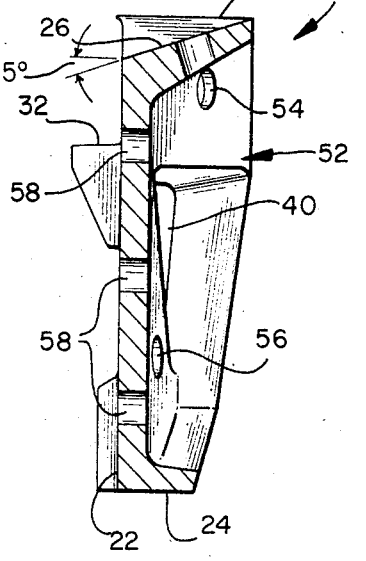
FIG. 8 is a cross-sectional view taken along line 8—8 of FIG. 5; and, FIGS. 9–15 illustrate various different configurations of clusters which can be achieved by utilizing the apparatus disclosed in FIGS. 4–7.

The longitudinal slot 22 is also referred to herein as a first connection 22. The first and second connections 22 and 26, respectively, each are aligned to be bisected by a common vertical plane as seen at 8—8 in FIG. 5. A strut attached to the first and second connections is arranged at 105° included as noted in FIG. 8 of the angle respective to the interior of the framed building.

The before mentioned opposed connections 32 and 34, respectively, form a third connection 32 which lies in a bisecting plane with respect to a fourth connection 34 respectively. Struts attached to the third and fourth connections lie at an included angle of 120° as noted in FIG. 6.

Diagonal connections 36 and 38, respectively, form a fifth and sixth connection, respectively. The fifth connection 36 lies in a plane which intersects the plane of sixth connection 38 at an included angle of 60°. Struts attached to connections 36 and 38 therefore form an included angle of 60°.

Struts attached to connections 34 and 38 form an included angle of 60° while struts attached to connections 22 and 34 form an included angle of 90° as noted in FIG. 5.

The term "strut" is intended to include 2×4 studs, as well as wooden and metallic elongated members.

Figure 9:
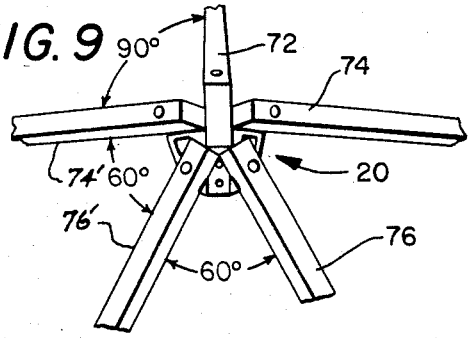

FIG. 9 illustrates a connector plate 20 which forms a cluster comprised of struts 72, 74, 76, 76′ and 74′; each having the ends thereof affixed to connections 26, 34, and 38, there being no strut received within the first connection 22. Strut 72, as viewed in FIG. 9, forms an included angle of 90° respective to strut 74; and strut 74 forms an included angle of 60° respective to strut 76 as noted by the arrows. Strut 72, when viewed in a vertical plane which passes longitudinally through strut 72, lies at an included angle of 150° respective to strut 76. Accordingly, strut 72 forms a roof strut and provides a roof pitch of 15° respective to the horizontal when strut 76 is arranged in a vertical plane.

Figure 10:
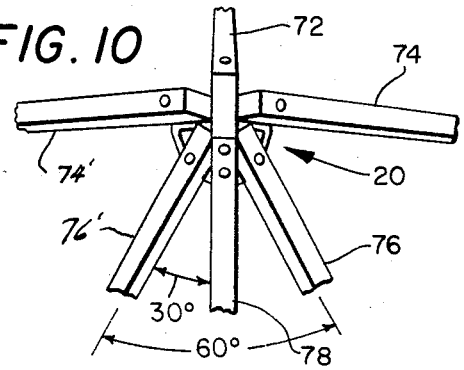

In FIG. 10, there are six struts connected to form a cluster by utilizing each of the six connections formed within the connector plate 20. The cluster seen in FIG. 10 is advantageously employed to provide a roof strut 72, an upper frame strut 74 for the ceiling, a vertical wall strut 78, and opposed oblique struts 76, 76′ which form an included angle of 60° therebetween.

Figure 11:
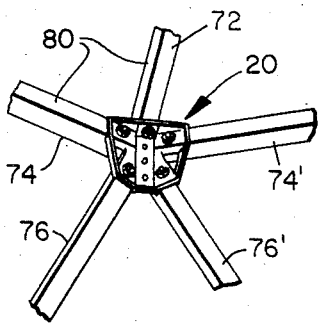

FIG. 11 illustrates the opposed side of the cluster seen in FIG. 9. FIG. 9 illustrates the use of the connector plate 20 to form a cluster comprised of a roof strut 72, ceiling struts 74, 74′ and diagonal sidewall members 76, 76′.

Figure 12:
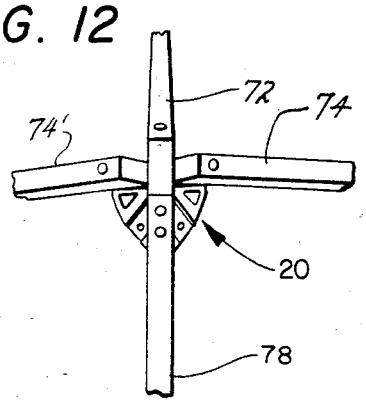

FIG. 12 illustrates the use of the connector plate to form a cluster comprised of roof strut 72, ceiling struts 74, 74′ and vertical strut 78.

Figure 13:
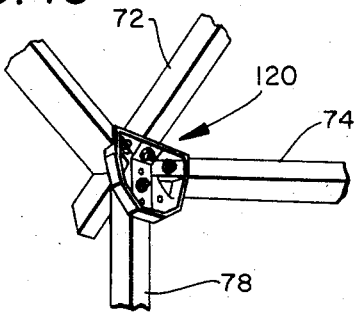

FIG. 13 illustrates the manner in which the strut ends are bolted to the connector plate, and the ease with which a roof overhang is achieved with the cooperative action of the second connection.

Figure 14:
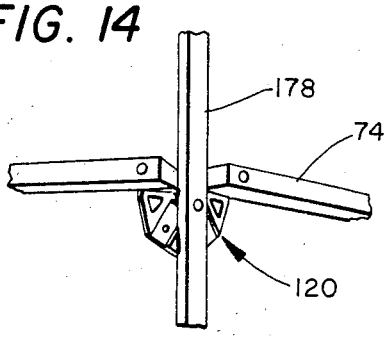

FIG. 14 illustrates a cluster for use in forming an upper floor of a building structure wherein vertical member 178 continues towards the roof.

Figure 15:
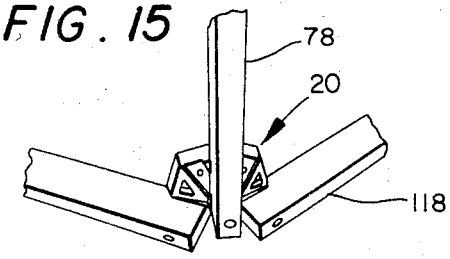

FIG. 15 illustrates the use of the connector plate in attaching a vertical member 78 to adjacent base or floor struts 118.

Those skilled in the art, having digested the drawings and the foregoing descriptive portion of this disclosure, will readily appreciate that the clusters seen in FIGS. 9–15 are selectively used in fabricating various different configurations of building structures as exemplified in FIGS. 1–3.

The connector plate of this invention can therefore be advantageously used for erecting building structures, such as seen in FIGS. 1–3, as well as building structures of other varied configurations. The plate 20 comprises a main body having six strut connections 22, 26; 32, 34; and 36, 38; as well as the edge portions 28, 30; all of which can advantageously be used to form a cluster in the above illustrated manners.

The different clusters include 1–6 struts assembled in the illustrated manner of FIGS. 1–3 and 9–15. The connector plate of FIGS. 1–15 has a plane of symmetry which bisects the connector plate as indicated by the arrows at numerals 8—8 in the manner of FIGS. 5 and 8, and which passes through the strut connections 22 and 26. Connections 22 and 26 lie at an obtuse angle respective to one another and provide attachment means for a roof strut end and a vertical wall strut end in order to position the roof strut to achieve a 15° roof pitch.

There are two right and two left connections lying to either side of the plane of symmetry, with the two right connections having a strut receiving surface lying in the same plane, and with the struts attached thereto intersecting one another at an angle of 60° to thereby form the apex of one equilateral wall triangle. The plane of a triangle formed by the two right connections lie 60° respective to the plane of a triangle formed by the two left connections, thereby providing for a six sided or hexagon building having a hexagon roof made of six triangular sections. Moreover, the walls can be made into a square, rectangle, or triangular wall surface in the illustrated manner of FIGS. 1–3 and 9–15.

The connector plate of the present invention aids the novice builder in erecting structures of varied designs with very little attention to the particulars of engineering design. The connector plate provides speed and ease of construction, and no special tools or special knowledge or skills are required.

EXAMPLE

In the building structure of FIG. 2, the roof consists of six equilateral triangles, which require six main roof struts. Larger buildings will require additional struts to keep the roof from sagging, and for strength.

In most cases an overhang is recommended, however, because of the extra space afforded by the connector plates themselves, roof struts the same length as the floor and sill plates will offer a very slight overhang, sufficient to weatherproof the structure. Larger overhangs are easily incorporated simply by using longer 2×4s and adding the additional length to the 1½ in. normal bolt location.

One should draw up a list of materials needed to rough in the structure. Twelve connector plates are required. The basic frame will require six floor plates, six sill plates, twelve oblique corner struts, six roof butt plates, and six roof struts, or 36 2×4s.

The hobbist will also need a center plate made from a scrap of ¾ in. plywood about 9 in. square, 2 5/16×4 in. carriage bolts with washers and nuts, and nails. Tools include a drill with a 5/16 in. bit, tape measure, wrench, hammer and saw.

When one has built his structure in his mind, and has assembled the materials and tools, he is ready to begin. The site is smoothed and leveled.

Drill 5/16 in. holes 1½ inches from each end of the 2×4s of the basic frame. Allow for roof overhang on six of them, and mark the location carefully on the 2 in. edge of the 2×4, making certain to mark on the same side of each piece.

Insert the bolts in the opposite side from which the drill entered. It is hard to drill straight, through 4 in. of wood (a drill press helps) but by drilling from the same side on each end, and by inserting the bolt from the opposite side, sufficient accuracy is assured. The slightly ovoid or parabalated bolt holes in the connector plates also allow for somewhat less-than-perfect drilling.

Tap the bolts in with a hammer, and attach them to the appropriate connections. Draw the heads of the bolts into the wood securely.

Lay out the base first. Then, bolt on two oblique struts and attach the sill between them. Proceed around the building in that fashion until the walls are complete.

Next, make the centerpiece from a scrap of ¾ in. plywood. This centerpiece is the same for all hexagonal buildings, regardless of size or wall configuration, and can be fabricated from metal, rather than plywood, if desired. Bolt the first roof strut to the centerpiece, then to any of the top connector plates. Attach the second roof strut opposite the first, to stabilize them while you proceed around the roof, adding the other four. The basic frame is done.

Next it is a simple matter to add the other studs, frame in the door and windows, and add the sheathing and roof. Finishing along with vertical siding, clapboard, shingles, slabwood, and the like can be achieved as desired.

I claim:

1. A connector plate for securing a plurality of struts into a building structure of varied configuration, comprising; a main rigid body of unitary design having a plurality of strut receiving connections formed therein;

said connector plate having an outer surface opposed to an inner surface with said connections being formed on said outer surface;

a longitudinally extending connection located along a plane of symmetry which terminates in a short roof connection arranged to form an obtuse angle therebetween;

opposed connections arranged on opposed sides of and perpendicular to said longitudinally extending connection with the opposed connections with said lower connections forming an inclinded angle of 60° therebetween.

2. The connector plate of claim 1 wherein said inner surface is of general concave shape, there being a peripheral wall surface formed about said outer surface, including opposed base wall surfaces adjacent to and perpendicular to said opposed connections, said base wall surfaces are separated from one another by said short roof connection, said base wall surfaces are arranged at an obtuse angle respective to one another.

3. The connector of claim 1 wherein said connections are arranged wherein said longitudinally extending connection is located on said face at a higher elevation respective to the remaining connections, each of the remaining connections slope away from said longitudinally extending connection.

4. The connector of claim 1 wherein each said connection is a rectangular surface defined by edges which engage the edge of a strut and rigidify the resultant structure.

5. The connector of claim 1 wherein said rear face is of general concave shape, there being a peripheral wall surface formed about and extending from said outer face, including opposed base wall surfaces adjacent to and perpendicular to the opposed connection surfaces, said base wall surfaces are separated from one another by said short roof connection, said base wall surfaces are arranged at an obtuse angle respective to one another for attachment to the floor of a building;

said longitudinally extending connection is at a higher elevation respective to said other connections, said other connections each slope away from each other and from said longitudinally extending connection.

6. The connector of claim 1 wherein said longitudinally extending connection is formed at a high elevation respective to the remaining connections, and each of the remaining connections slope away from the longitudinally extending connections;

each connection surface is defined by opposed elongated edges which can engage the edge of a strut rigidify any resultant frame that may be built with the connector.

7. The connector of claim 1 wherein said rear face is of general concave shape, there being a peripheral wall surface about said outer face, including opposed base wall surfaces adjacent to and perpendicular to said opposed connections, said base wall surfaces are separated from one another by said short roof connection, said base wall surfaces are arranged at an obtuse angle respective to one another for attachment to a floor of a building;

each connection includes a surface defined by elongated edges which can engage the edge of a strut and thereby rigidifies a frame.

8. A connector body having a front face which is abuttingly affixed to a plurality of struts to form a cluster of a building frame;

said connector body is of unitary structure and includes individual surfaces each of which receive a strut end in fixed relationship therewith;

there being a first elongated surface for receiving a vertical strut, said first elongated surface terminates in a short second surface, said second surface receives a roof strut; said first and second surfaces form an obtuse angle therebetween when measured on the side opposite to the front face;

opposed upper strut receiving surfaces for receiving the ends of a ceiling strut, said upper surfaces form an obtuse angle therebetween when measured on the side opposite to the front face, and are spaced apart by said first surface;

a diagonal strut receiving surface located on opposed sides of and arranged at an acute angle respective to said first surface;

there being six strut receiving surfaces, the first surface lies at a higher elevation than the other five surfaces, the last five surfaces slope downward and away from the first surface.

9. A connector plate for attachment to the ends of a plurality of struts and thereby form a cluster of struts, said plate having a front face opposed to a rear face, a plurality of strut receiving surfaces formed on the front face; said front face is of general convex construction which slopes towards the peripheral edge thereof;

a first connector surface for receiving a vertical wall strut, a second connector surface for receiving a roof strut, a third and fourth connector surface separated from one another by said first and second connector surface, said third and fourth struts are arranged at an angle to one another and perpendicular repsective to said first and second struts; said first and second struts lie at an included obtuse angle therebetween when measured on the side opposite to the front face; said third and fourth struts lie at an included obtuse angle therebetween when measured on the side opposite to the front face; a fifth and sixth connector surface arranged on opposed sides of said first connector and form an included acute angle therebetween;

said third and fifth surfaces lie in a first common plane, said fourth and sixth struts lie in a second common plane, so that struts attached at the third and fifth connector surfaces form an apex of a first triangle while struts attached at the fourth and sixth connector surfaces form an apex of another tirangle, with said first and another triangles being arranged at an obtuse angle respective to one another.

10. The connector plate of claim 9 wherein said inner surface is of general concave shape, there being a peripheral wall surface formed about said outer surface, including opposed base wall surfaces adjacent to and perpendicular to said third and fourth surfaces, said base wall surfaces are separated from one another by said second wall surface, said base wall surfaces are arranged at an obtuse angle respective to one another.

11. The connector plate of claim 9 wherein the connections are arranged wherein said first connection is located on said face at a higher elevation respective to the remaining connections, each of the remaining connections slope away from the first connection.

12. The connector plate of claim 9 wherein each said connection is a rectangular surface defined by edges which engage the edge of the strut and rigidify the resultant structure.

13. The connector plate of claim 9 wherein said rear face is of general concave shape, there being a peripheral wall surface formed about and extending from said outer face, including opposed base wall surfaces adjacent to and perpendicular to the third and fourth connection surfaces, said base wall surfaces are separated from one another by said second connection, said base wall surfaces are arranged at an obtuse angle respective to one another for attachment to the floor of a building;

said first connection is at a higher elevation respective to said other connections, said other connections each slope away from each other and from said first connection.

14. The connector plate of claim 9 wherein said first connection is at a high elevation respective to the remaining connections and each of the remaining connections slope away from the first connection;

each connection surface includes elongated edges which engage the edge of a strut and rigidify the resultant frame.

* * * * *